US005675846A

United States Patent [19]

Kannenberg

[11] Patent Number: 5,675,846

[45] Date of Patent: Oct. 14, 1997

[54] BRUSH-MASSAGE SHOWER INSTALLATION

[76] Inventor: Erich Kannenberg, August-Dissen-Strasse 47, D-34414 Warburg 1, Germany

[21] Appl. No.: 620,339

[22] Filed: Mar. 22, 1996

[30] Foreign Application Priority Data

Mar. 24, 1995 [DE] Germany ..... 195 10 805.1

[51] Int. Cl.[6] ..... A47K 3/22

[52] U.S. Cl. ..... 4/606; 4/605; 15/21.1

[58] Field of Search ..... 4/606, 605; 15/21.1, 15/88.3, 88.4; 601/114, 112

[56] References Cited

U.S. PATENT DOCUMENTS

| | | | |
|---|---|---|---|
| 3,091,776 | 6/1963 | Roberts | 4/606 |
| 3,196,867 | 7/1965 | Perry | 4/606 |
| 3,862,459 | 1/1975 | Brunette . | |
| 4,008,503 | 2/1977 | Tharp | 4/606 |

FOREIGN PATENT DOCUMENTS

| | | |
|---|---|---|
| 7206826 | 7/1972 | Germany . |
| 68902499 | 8/1992 | Germany . |

*Primary Examiner*—David J. Walczak
*Attorney, Agent, or Firm*—Browdy and Neimark

[57] ABSTRACT

The devices of the brush-massage shower installation described in detail above do not pose any problems in practical application, while a person lets his body be massaged with the skin-friendly bristles, which he has selected himself, of a dry or water-spraying and wet-cleaning rotating massage roller (8).

The brush-massage shower installation contains the advantages of freedom in the selection of the driving elements.

a.) The water turbine gear (14), which is responsible for the infinitely variable drive of the water-spraying rotating massage roller (8), obtains its rotational force from the water supply provided, which is under pressure.

b.) The dry-running rotating massage roller (8) is put into motion by a gear motor, the design of which is kept flat and which is electrically protected and infinitely variable and which is located in the outer wall side (19) of the bath, from where it puts the electrically protected gear (15) connected to the inner wall side (1) into motion for rotating the rotating massage roller.

A full brush massage with the rotating massage roller (8) invigorates the human body and spirit. It sees to a good blood flow through the skin and body, by which it stimulates the metabolism, strengthens the vegetative nervous system and the immune system, increases the resistance to infectious diseases and thus awakens the human zest for life.

25 Claims, 2 Drawing Sheets

BRUSH-MASSAGE SHOWER INSTALLATION

BACKGROUND OF THE INVENTION

1. Field of Technology

The invention relates to a brush-massage shower installation with a motor-driven brush roller which is rotatably seated in a support frame (5) fixed in place on a wall (20).

Such an installation constitutes an additional expansion of a conventional sanitary installation. For this purpose the support frame (5) is installed on a fixed wall above a shower tub or bath tub, preferably in a shower enclosure. In place of a fixed wall it is of course also possible to employ a support frame or the like specially provided for this. Standing in the tub, the user of the brush-massage installation can let the motor-driven brush roller massage and brush him, which aids the circulation and the blood flow and in this way is used for preventive health care.

2. Object and Summary of the Invention

It is the object of the invention to further develop a brush-massage shower installation of the type mentioned at the outset in such a way that it is usable for dry body massage as well as wet body cleaning and in addition operates in the best possible energy-saving manner.

This object is attained in that the brush roller is connected via a main drive shaft with a main drive gear, which is coupled via a free-wheeling device with a drive shaft of a water-powered pressure medium motor having at least an inlet and an outlet line for the water driving the pressure medium motor, and which is coupled via a free-wheeling device with a drive shaft of an auxiliary gear connected with an electric motor. The brush roller has a hollow, elongated core provided with bristles, and is provided with a multitude of radially or oblique-radially extending holes. The hollow space is closed at one linear end and has a hose connector for connection with the water outlet line of the pressure medium motor on a linear end.

When used for wet cleaning, the brush roller is driven by the pressure of the water which is to be used anyway. Therefore no additional energy for driving the brush roller is required. The water leaving the pressure medium motor is conducted via an outlet line into the hollow space inside the brush core of the brush roller, from where it is sprayed outward through the holes by means of the centrifugal forces being generated by the rotation of the brush. The brush is always maintained evenly moist in this way. In order to perform a dry massage, the drive can selectively take place via an auxiliary gear driven by an electric motor in place of the pressure medium motor.

The brush roller is advantageously releasably maintained on its two long ends in the support frame and can therefore be exchanged. A drive head for the brush roller is located at one long end of the support frame. The connection between the brush roller or drive head and the main gear is advantageously provided by a flexible spring core shaft so that the brush roller can be flexibly pivoted back and forth. For this purpose the brush roller is advantageously vertically arranged and the support frame is connected via a hinge with a support rail vertically fastened on the wall. The support frame preferably consists of several frame sections connected with each other by means of hinges and is therefore collapsible when the brush roller has been removed, so that when the installation is not being used it does not take up too much space in the shower enclosure. In a special embodiment the collapsed support frame, which interchangeably receives the brush roller, can be pivoted into a lockable storage box.

It is of course also possible to embody the main drive shaft as a swivel joint shaft instead of as a flexible spring core shaft, which is connected with the drive head via a gear wheel, for example. Alternatively it is also possible to embody the main drive shaft as a fixed shaft which then in turn is connected with the drive head by means of a V-belt.

The main gear, the pressure medium motor and the auxiliary gear are preferably disposed on the inside of a wall within the wet area. The electric motor is disposed outside of the wet area protected from spray and is connected with the auxiliary gear via an insulated shaft. A rotary switch is then advantageously disposed within the wet area and is connected by means of a connecting shaft with a potentiometer outside of the wet area, which in turn is electrically connected to the electric motor and controls its rpm. The electric motor is preferably provided with an overload switch. The main gear or the drive head are also provided with a slipping clutch to prevent a mechanical overload.

The direction of running of the main gear can preferably be manually changed or it can be switched into idle by means of a rotary switch or a contact arm.

The bristles of the brush roller can be natural bristles or can be made of plastic. Strips of leather or rubber of various length and different hardness can be disposed on the brush core in addition or alternatively to the bristles. The leather strips or rubber strips are preferably releasable for exchange, for example they are fastened so that they can be screwed, plugged or clamped in the brush core. The leather or rubber strips can be of any arbitrary consistency, i.e. they can be thick or thin, rounded or angular, rough or smooth, soft or hard. It is also possible to apply rubber or leather strips of different materials to different areas, for example to intermix different rubber or leather strips or bristles.

The brush core is preferably made of wood, plastic, metal or of a combination of these materials and has an even angular cross section perpendicularly to the longitudinal axis, for example an octagonal cress section, or a round cross section.

It is particularly advantageous if inside the hollow space in the brush core a separating wall extends in a screw-like manner along the hollow space. This separating wall made of plastic is used to impart an additional twist to the inflowing water in order to improve the spray effect.

In a particularly advantageous embodiment a plug connection for the alternating connection of a flexible drive shaft of a rotating brush rod is respectively disposed at the pressure medium motor and the auxiliary gear. This brush rod can be manually used as an additional massage rod in order to also massage places where a massage by means of the large brush roller is not possible. The drive shaft of the brush rod is preferably a spring core shaft. The brush rod is also a part of the invention.

The spring core shaft of the brush rod and of the brush roller are preferably contained in a sealed, flexible protective sheath filled with a lubricant. In an advantageous arrangement the pressure medium motor, the main gear and the auxiliary gear are disposed in housings made of metal or plastic and protected against spray. The main gear, the pressure medium motor and the drive shafts are made of metal or plastic or of a combination of these materials.

BRIEF DESCRIPTION OF THE DRAWINGS

The invention will be explained in detail below, making reference to the attached drawings.

Figure 1:
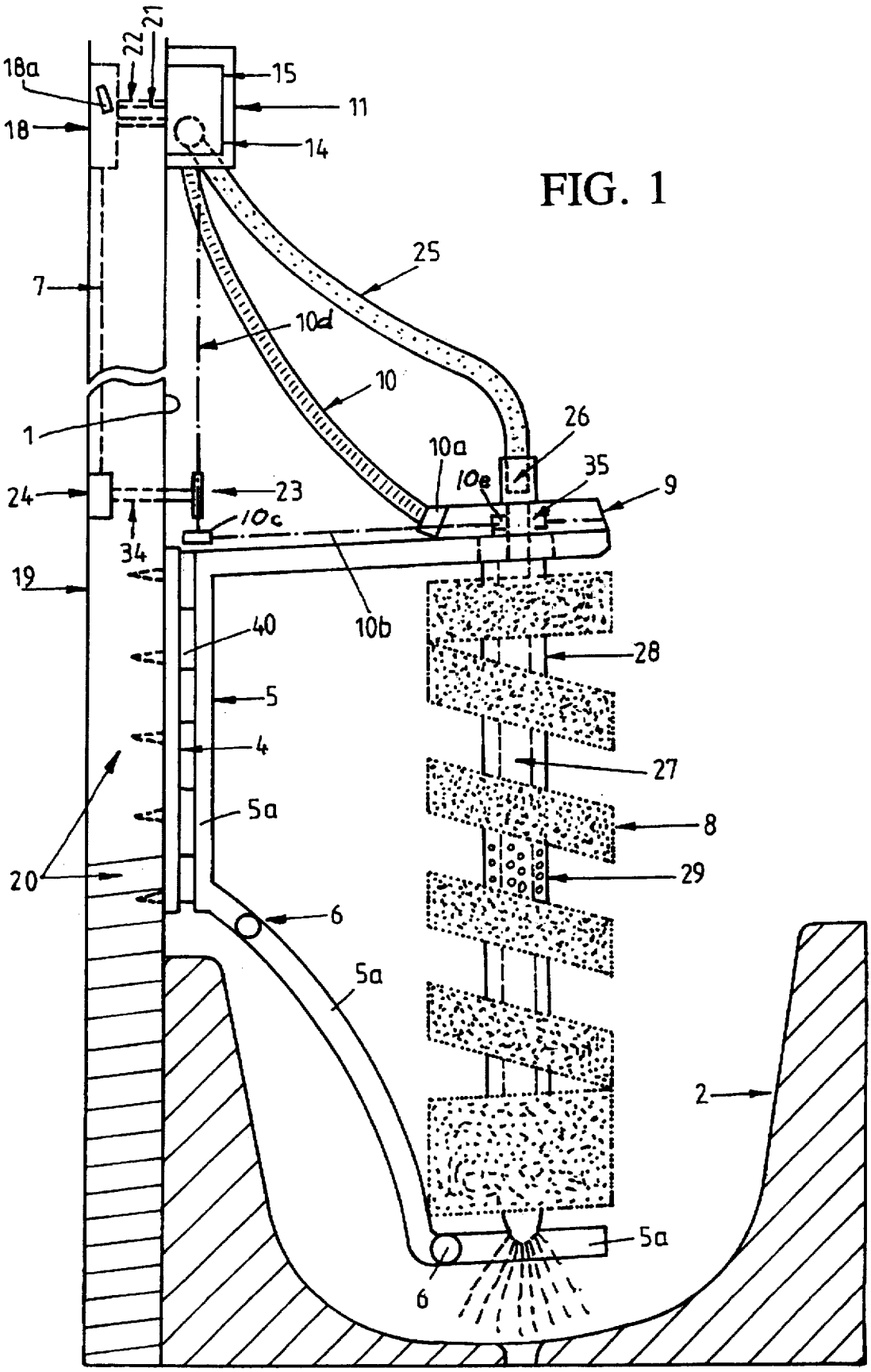
FIG. 1 is a lateral elevation view of the brush-massage shower installation in accordance with the invention, disposed on a fixed wall above a bathtub (tub and wall are shown in a sectional view.

A wall rail (4), vertically fastened by means of plugs or screws or the like, on which a stable brush support frame (5) is fastened by means of hinges (40) in a vibration-free, pivotable and adjustable manner, is located on the solid inside (1) of a wall (20) (FIG. 1) of a bath above the upper rim and in the base area of a bathtub (2), or above the upper rim of a stand-up tub of a shower stall, or in another wall area. The support frame 5 can consist of several frame sections (5*a*) connected by hinges (6) to be collapsible.

A perpendicularly extending rotatable and exchangeable brush roller (8) is inserted and held at both ends by the brush support frame (5) and is driven at its upper end by a drive head (9). The drive head (9) is connected with a short, flexible spring core shaft (10), which is connected to a main gear (11) as a rotatory-force-transmitting member. The main gear is selectively switched to right or left turning and can be driven by a pressure medium motor (water turbine) (14) or an electrically driven auxiliary gear (15) via two drive shafts (12, 13) (FIG. 2) connected to both sides.

Figure 2:
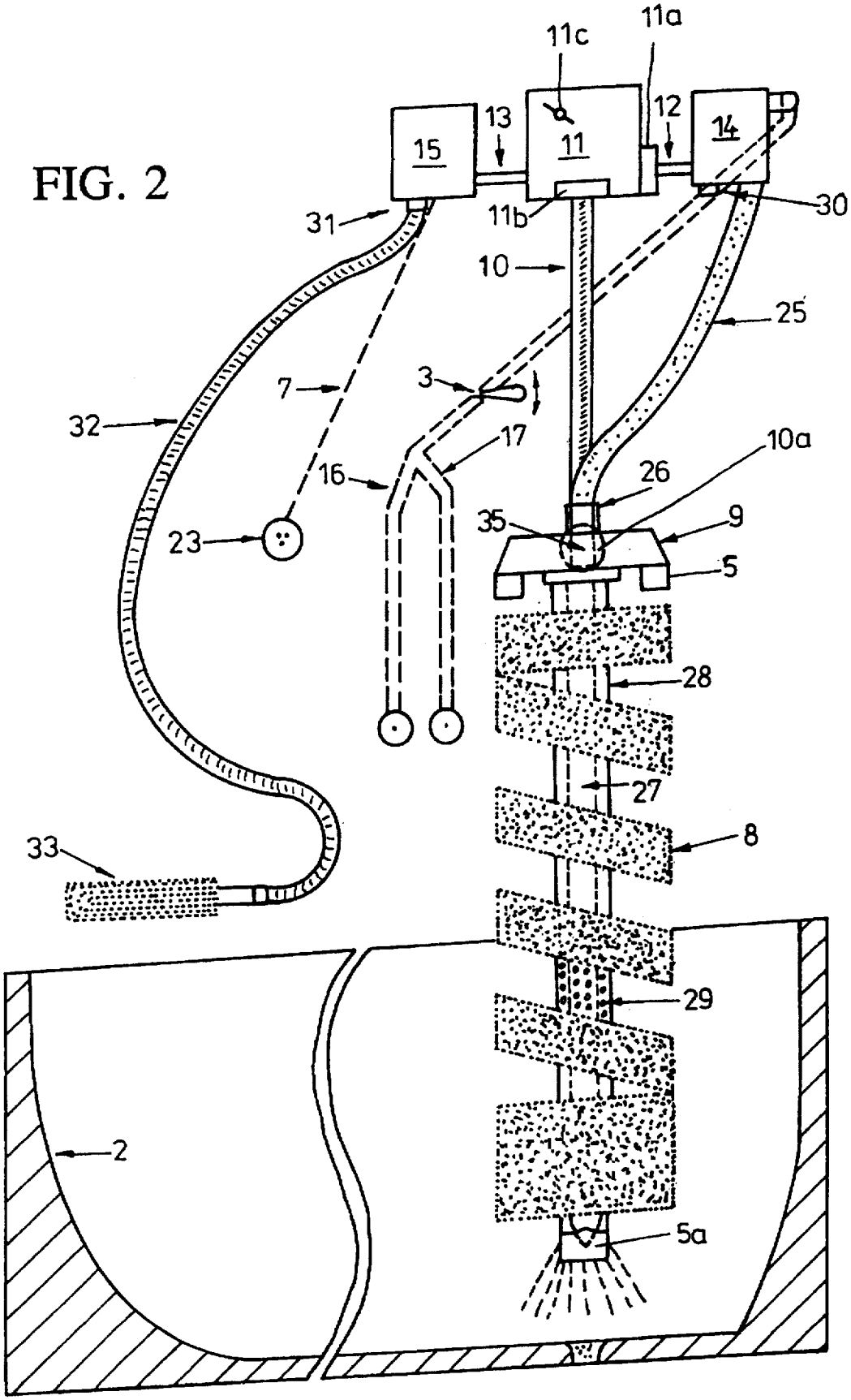
FIG. 2 is a front elevation view of the brush-massage shower installation in accordance with FIG. 1.

In the instant embodiment in accordance with FIGS. 1 and 2 the auxiliary gear (15), the main gear (11) and the pressure medium motor (14) are arranged side-by-side on the inside (1) of the wall (20) above the support frame (5).

In their useful form and size, the wall rail (4), the support frame (5) and the drive head (9) are made of metal or plastic.

The turbine of the pressure medium motor (14) (FIG. 2) is put into motion by the steady pressure of the water flowing through it, wherein the amount of water, which can be regulated via a closing and regulating element (3), from the combined and connected cold and hot water supply lines (16, 17) determines the rotational speed of the pressure medium motor (14). The pressure medium motor (14) transmits its rotatory force to the connected rotating shaft (12), which is connected as a rotatory-force-transmitting member to the main gear (11). The water outflowing from the switched-on water turbine (14) is conducted away by means of a connected flexible hose (25) and conducted into a hose connector (26) at the upper opening of the hollow space (27) in the brush core (28), where it is sprayed to the outside of the brush roller (8) through a multitude of horizontal openings (29) in the brush core (28).

The type of drive by means of a water turbine (14) has the advantage that the generally used shower water, which in a general sense is used up, can be used for driving the water-conducting and wet-cleaning brush roller (8), wherein the energy costs for driving the brush roller which can be saved daily can be quite considerable in an annual budget.

The main gear (11) can alternatively be driven by an infinitely variable electric motor (18), which is installed, protected against water spray, on the outside (19) of the bath. Contained in a protective sheath (22), the drive shaft (21) of the electric motor (18) is passed through the solid wall (20), where it is connected at the inside (1) of the wall of the wet chamber with an auxiliary gear (15), which transmits its rotatory force to the main gear (11) via the connected drive shaft (13). A connecting shaft (34) leads from a rotary switch (23) installed on the inside (1) of the wall through the solid wall (20) to a mechanically rotatable and infinitely variable potentiometer (24) which controls the electric motor (18), again via a connecting cable (7).

The electric motor (18) which has an overload switch (18*a*) is kept flat in its structure and in the shape and is installed in a sturdy insulated motor housing box having a motor housing lid with ventilating slits, which covers the motor and can be removed. The electrical connections of the electric motor (18) have been moved outside the closed motor housing box. The electric motor (18) has been installed with its protective motor housing box on the outside of the wall sufficiently deep into the solid outer wall side (19) so that the motor housing lid is aligned level with the outer wall side (19).

The suitably long and strong drive shaft (21) of the electric motor (18) can be screwed into the protectively insulated center of its armature (18).

The auxiliary gear (15) has a housing which in its useful form and size is made of plastic or metal, the same as the gear mechanism located on the inside. The auxiliary gear (15) can be manually switched into two rotating stages and an idle stage by means of a rotary switch or a contact arm seated on the outside. The laterally connected drive shaft (13) to the main gear (11) is also made of plastic or metal.

The pressure medium motor (14) also has a housing, and in their useful form and size the housing of the turbine and gear mechanism of the pressure medium motor 14 are made of metal or plastic. The connected force-transmitting drive shaft (12) is made of metal or plastic.

The main gear (11) also has a housing. In their useful shape and size, the housing and gear mechanism of the main gear (11) are made of metal or plastic. Because of its free-wheeling device (11*a*), the main gear (11) is operated by the auxiliary gear (15) and the pressure medium motor (14) only when the drive shafts (12, 13) turn right.

The main gear (11) can be switched into an interchangeable right or left turning or into free-wheeling and the rpm can be infinitely varied by means of a mechanical rotary switch (11*c*) or contact arm.

The brush roller (8) should preferably be protected against mechanically acting rotational overloads. For these reasons the electric motor (18) and the main gear (11) or the drive head (9) are equipped with a slipping clutch (11*b*) to protect them against a too strong electrical current or against mechanical overload.

The drive head (9) can also be driven by a swivel joint shaft with a gear wheel connection (10*a*) made under the main gear (11), instead of a flexible spring core shaft (10). Alternatively the drive head (9) can also be driven by means of a shaft (10*d*) connected underneath the main gear (11) with a V-belt pulley (10*c*) located at the lower shaft end of shaft (10*d*), on which an accident-protected installed V-belt (10*b*) is mounted, which in turn puts an also accident-protected installed V-belt pulley (10*e*) of the drive head (9) and the brush roller (8) connected therewith into motion.

The brush core (28) of the brush roller (8) is made of wood, plastic or metal. The exterior surface has an evenly round or an evenly angular shape (for example hexagon or octagon).

A thin continuous separating wall of plastic is inserted into the continuous hollow space (27) of the brush core (28) of the brush roller (8) which, by means of its slight continuous twist, forces the water which is passed into it to flow against the interior wall of the hollow space (27) in the brush core, where it is sprayed outside of the brush roller (8) through the multitude of horizontal holes (29).

The bristles on the outside of the brush core (28) of the brush roller (8) can be made of any usable natural hair or any usable natural materials or artificial materials. The brush roller can also be equipped with different types of bristles.

wherein different bristle structure shapes, any bristle density and any bristle length is possible.

The brush roller (8) can also alternatively or additionally be provided with fine or coarse leather strips or leather pieces of any length and of any thickness in a compensating ratio between mass and density.

The brush roller (8) also can have increasingly thicker, round or angular, rough or smooth, soft or increasingly harder rubber strips or similar strips made of a different material, which are fixedly fastened by their one end on the roller at any allowable thickness and length. These rubber strips and different types of material strips are preferably fastened on the outside of the brush core (28) in an interchangeable manner by being screwed in, plugged in, clamped or in other ways.

The pressure medium motor (14) (FIG. 2) has a plug connector (30). The electrically driven gear (15) is equipped with a plug connector (31), so that a long, flexible spring core shaft (32) in a protective sheath can be alternately connected to each of these plug connectors (30, 31), on whose free end a rotatable and interchangeable brush rod (33) can be connected and can be freely used for cleaning and massaging all parts of the human body.

The flexible spring core shafts (10, 32) of the brush roller (8) and the brush rod (33) are guided in a sealed protective sheath filled with a lubricating grease, in which they can frictionless rotate.

The two different forms of propulsion, by a water-operated pressure medium motor (14) and an electrically operated gear (15), have the advantage that in case of an outage of one of these drive units it is not necessary in any way to do without a daily dry body massage or wet, refreshing body cleaning.

Thus, a brush-massage shower installation opens the option to many sick, elderly or handicapped persons to partake of a full body massage or a refreshing body cleaning on their own. Following a massage application, for example in a bathtub (2), the brush roller (8) can be removed from the brush support frame (5) by easy manipulations, so that the lower frame half located in the bathtub (2) can be flipped up with the aid of the foldable frame hinges (6) and can be pivoted in a space-saving manner in the direction of the inner wall side (1) into, for example, a lockable box.

| No. | List of Reference Numerals |
|---|---|
| 1 | Inside of wall |
| 2 | Bathtub |
| 3 | Safety shut-off valve |
| 4 | Support rail |
| 5 | Support frame |
| 6 | Frame hinges |
| 7 | Connecting cables |
| 8 | Brush roller |
| 9 | Drive head |
| 10 | main drive shaft |
| 11 | Main gear |
| 12 | Drive shaft |
| 13 | Drive shaft |
| 14 | Pressure medium motor |
| 15 | Auxiliary gear |
| 16 | Water supply line/inlet line |
| 17 | Water supply line/inlet line |
| 18 | Electric motor |
| 19 | Outside of wall |
| 20 | Solid wall |
| 21 | Drive shaft |
| 22 | Protective sheath |

-continued

| No. | List of Reference Numerals |
|---|---|
| 23 | Rotary switch |
| 24 | Potentiometer |
| 25 | Water outlet line |
| 26 | Hose connector |
| 27 | Hollow space in the brush core |
| 28 | Brush core |
| 29 | Perforations in the brush core |
| 30 | Plug connector |
| 31 | Plug connector |
| 32 | Spring core shaft |
| 33 | Brush rod |
| 34 | Connecting shaft |
| 35 | Opening in the drive head |

I claim:

1. A brush-massage shower installation comprising:

a motor-driven brush roller (8), said brush roller (8) rotatably seated in a support frame (5), said support frame adapted to be fixed in place on a wall, a main drive gear (11) being connected via a main drive shaft (10) to said brush (8), a first drive shaft (12) of a water-powered pressure medium motor (14) coupled via a free-wheeling device (11*a*) to said main drive gear (11), said water-powered pressure medium motor (14) having at least a water inlet line (16, 17) and a water outlet line (25) to permit water to drive the water-powered pressure medium motor (14), a second drive shaft (13) of an auxiliary gear driven by an electric motor (18) coupled via said free wheeling device (11*a*) to said main drive gear (11), said brush roller (8) having a hollow, elongated brush core (28) provided with bristles and a plurality of radially extending holes, a hollow space (27) arranged within said hollow elongated brush core (28) being closed at a first end and having a hose connector (26) at a second end, wherein said hose connector (26) is connected to said water outlet line (25) of the water-powered pressure medium motor (14).

2. The brush-massage shower installation in accordance with claim 1, wherein the brush roller (8) is releasably held at both linear ends in the support frame (5) and a drive head (9) for the brush roller (8) is disposed on a linear end on the support frame (5).

3. The brush-massage shower installation in accordance with claim 2, wherein the main drive shaft (10) is a swivel joint shaft which is connected with the drive head (9) via a gear wheel connection (10*b*).

4. The brush-massage shower installation in accordance with claim 2, wherein the main drive shaft (10) is a rigid shaft which is connected with the drive head (9) via a V-belt.

5. The brush-massage shower installation in accordance with claim 2, wherein the brush roller (8) is perpendicularly arranged and the support frame (5) is connected via a hinge to a support rail (4) adapted to be perpendicularly fastened on the wall (20).

6. The brush-massage shower installation in accordance with claim 5, wherein the support frame (5) is collapsible and consists of several frame sections connected with each other via hinges (6).

7. The brush-massage shower installation in accordance with claim 1, wherein the main drive shaft (10) is a flexible spring core shaft (10).

8. The brush-massage shower installation in accordance with claim 7, wherein the spring core shaft (10) is disposed in a sealed flexible protective sheath filled with lubricant.

9. The brush-massage shower installation in accordance with claim 1, wherein the main drive gear (11), the water-powered pressure medium motor (14) and the auxiliary gear (15) are adapted to be located on an inside (1) of the wall (20) within wet area, and the electric motor (18) is adapted to be located outside the wet area and is connected with the auxiliary gear (15) via an insulated shaft (21).

10. The brush-massage shower installation in accordance with claim 9, wherein the electric motor (18) has a protectively insulated housing and is disposed in back of the auxiliary gear (15) adapted to be placed on an outside (19) of the wall (20) and is connected with the auxiliary gear (15) via a rigid shaft (21), which is provided with a protective sheath (22) and is adapted to pass through the wall (20) and is screwed to an armature of the electric motor (18).

11. The brush-massage shower installation in accordance with claim 10, wherein the electric motor (18) is embedded in a housing adapted to be placed on the wall (20), and the housing is adapted terminate flush with the outside (19) of the wall (20).

12. The brush-massage shower installation in accordance with claim 9, wherein a rotary switch (23) is adapted to be disposed on the wall (20) within the wet area, which is connected via a connecting shaft (34) with a potentiometer (24), which is electrically connected with the electric motor (18).

13. The brush-massage shower installation in accordance with claim 1, wherein the electric motor (18) has an overload switch.

14. The brush-massage shower installation in accordance with claim 1, wherein the main gear (11) or the drive head (9) have a slipping clutch.

15. The brush-massage shower installation in accordance with claim 1, wherein the main gear (11) can be manually reversed in a direction of running or switched to free-wheeling by means of a rotary switch (11*c*).

16. The brush-massage shower installation in accordance with claim 1, wherein the bristles of the brush roller (8) are made of natural bristles.

17. The brush-massage shower installation in accordance with claim 1, wherein the bristles of the brush roller (8) are made of plastic.

18. The brush-massage shower installation in accordance with claim 1, wherein strips of leather or rubber are disposed in different lengths and different hardness on the brush core (28).

19. The brush-massage shower installation in accordance with claim 18, wherein the leather strips or rubber strips are releasably disposed on the brush core (28).

20. The brush-massage shower installation in accordance with claim 1, wherein the brush core (28) is made of wood, plastic, metal or a combination of these materials and has an evenly angular or round cross section perpendicular to the longitudinal axis.

21. The brush-massage shower installation in accordance with claim 1, wherein a screw-like turned separating wall of plastic, extending along the hollow space (27) in the brush core (28), is disposed in the hollow space (27).

22. The brush-massage shower installation in accordance with claim 1, wherein a plug connector (30, 31) for the alternative connection of a flexible drive shaft (32) of a rotatable brush rod (33) is disposed respectively on the water powered pressure medium motor (14) and on the auxiliary gear (15).

23. The brush-massage shower installation in accordance with claim 1, wherein the drive shaft (32) of the brush rod (33) is a spring core shaft (32) disposed in a sealed, flexible protective sheath filled with lubricant.

24. The brush-massage shower installation in accordance with claim 1, wherein the pressure medium motor (14), the main gear (11) and the auxiliary gear (15) are disposed in housings made of metal or plastic.

25. The brush-massage shower installation in accordance with claim 1, wherein the drive shafts (12, 13, 21), the main gear (11), the auxiliary gear (15) and the pressure medium motor (14) are made of metal or plastic or of a combination of these materials.

* * * * *